US008720398B2

(12) United States Patent
Park et al.

(10) Patent No.: US 8,720,398 B2
(45) Date of Patent: May 13, 2014

(54) CONTINUOUS VARIABLE VALVE LIFT APPARATUS

(75) Inventors: Sung Bong Park, Seoul (KR); Bosung Shin, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 13/551,378

(22) Filed: Jul. 17, 2012

(65) Prior Publication Data

US 2013/0139771 A1 Jun. 6, 2013

(30) Foreign Application Priority Data

Dec. 6, 2011 (KR) ..... 10-2011-0129815

(51) Int. Cl.
*F01L 1/34* (2006.01)

(52) U.S. Cl.
USPC ..... 123/90.16

(58) Field of Classification Search
USPC ..... 123/90.15, 90.16, 90.39, 90.44
See application file for complete search history.

(56) References Cited

U.S. PATENT DOCUMENTS

| | | | | |
|---|---|---|---|---|
| 5,165,370 | A * | 11/1992 | Beaumont | 123/90.16 |
| 6,135,075 | A * | 10/2000 | Boertje et al. | 123/90.16 |
| 6,477,998 | B1 * | 11/2002 | Nguyen | 123/90.16 |
| 6,491,008 | B1 * | 12/2002 | Zubeck | 123/90.16 |

FOREIGN PATENT DOCUMENTS

| | | | |
|---|---|---|---|
| JP | 10-131727 | A | 5/1998 |
| JP | 3996751 | B2 | 8/2007 |
| KR | 10-0245878 | B1 | 12/1999 |

* cited by examiner

*Primary Examiner* — Thomas Denion
*Assistant Examiner* — Daniel Bernstein
(74) *Attorney, Agent, or Firm* — Morgan, Lewis & Bockius LLP

(57) ABSTRACT

A continuous variable valve lift apparatus may include an input cam disposed to an input shaft, a valve elastically supported by a valve spring, a rocker arm of which an end may be connected with the valve and the other end may be connected a rocker ratio change guide, which may be slidable along the length direction of the rocker arm and the rocker arm rotates around the rocker ratio change guide according to rotation of the input cam so as to open and close the valve, and a control portion selectively varies position of the rocker ratio change guide.

11 Claims, 2 Drawing Sheets

CONTINUOUS VARIABLE VALVE LIFT APPARATUS

CROSS-REFERENCE TO RELATED APPLICATION

The present application claims priority to Korean Patent Application No. 10-2011-0129815 filed in the Korean Intellectual Property Office on Dec. 6, 2011, the entire contents of which is incorporated herein for all purposes by this reference.

BACKGROUND OF THE INVENTION

1. Field of the Invention

The present invention relates to a continuous variable valve lift apparatus. More particularly, the present invention relates to a continuous variable valve lift apparatus which may realize continuous variable valve lift by changing length ratio of a rocker arm.

2. Description of Related Art

An internal combustion engine generates power by burning fuel in a combustion chamber in air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

An optimal operation of the intake valves and the exhaust valves depends on a rotation speed of the engine. That is, an optimal lift or optimal opening/closing timing of the valves depends on the rotation speed of the engine. In order to achieve such an optimal valve operation depending on the rotation speed of the engine, various researches, such as designing of a plurality of cam and a continuous variable valve lift (CVVL) that can change valve lift according to engine speed, have been undertaken.

However, the general CVVL is complicated in construction with considerable element parts and is expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve lift apparatus which may realize continuous variable valve lift by changing length ratio of a rocker arm with simple construction.

In an aspect of the present invention, a continuous variable valve lift apparatus may include an input cam disposed to an input shaft, a valve elastically supported by a valve spring, a rocker arm of which an end is connected with the valve and the other end is slidably engaged to a rocker ratio change guide, wherein the rocker ratio change guide is movable along a length direction of the rocker arm, wherein the input cam is engaged to a side of the rocker arm and the rocker arm rotates around the rocker ratio change guide according to a rotation of the input cam so as to open and close the valve, and wherein a control portion selectively varies a relative distance between the rocker ratio change guide and the end of the rocker arm.

The control portion may include a control shaft parallel to the input shaft, and a control cam which is disposed to the control shaft, contacts the rocker ratio change guide, and varies the relative distance between the rocker ratio change guide and the end of the rocker arm according to a rotation of the control shaft.

The continuous variable valve lift apparatus may further include an elastic member disposed between the other end of the rocker arm and the rocker ratio change guide for supplying a restoring force to the rocker ratio change guide.

A rocker arm insert hole is formed to the rocker ratio change guide, an elastic portion insert hole is formed to the other end of the rocker arm and the other end of the rocker arm is slidably inserted into the rocker arm insert hole, and the elastic member is disposed within the elastic portion insert hole and the rocker arm insert hole.

The rocker ratio change guide is disposed on a supporting portion and moves along a length direction of the rocker arm on the supporting portion according to an operation of the control portion.

The supporting portion is a cylinder head.

The continuous variable valve lift apparatus may further include a shim which is disposed between the supporting portion and the rocker ratio change guide and adjusts clearance therebetween.

A portion of the rocker ratio change guide which contacts the supporting portion is formed as a curved surface.

The continuous variable valve lift apparatus may further include a movement limit pin which is disposed on the supporting portion and limits a length direction movement of the rocker arm.

In another aspect of the present invention, a continuous variable valve lift apparatus may include an input cam disposed to an input shaft, a valve elastically supported by a valve spring, a rocker arm of which an end is connected to the valve and opens the valve according to an operation of the input cam, a rocker ratio change guide which is disposed to the other end of the rocker arm and slidable along a length direction of the rocker arm on a supporting portion, and a control portion selectively varies position of the rocker ratio change guide with respect to the rocker arm, wherein the rocker arm swings around the rocker ratio change guide according to the operation of the input cam.

The control portion may include a control shaft parallel to the input shaft, and a control cam which is disposed to the control shaft, contacts the rocker ratio change guide, and varies a relative distance between the rocker ratio change guide and the rocker arm according to an operation of the control shaft.

A rocker arm insert hole is formed to the rocker ratio change guide, an elastic portion insert hole is formed to the other end of the rocker arm and the other end of the rocker arm is slidably inserted into the rocker arm insert hole, and an elastic member is disposed within the elastic portion insert hole and the rocker arm insert hole for supplying restoring force to the rocker ratio change guide.

The continuous variable valve lift apparatus may further include a shim which is disposed between the supporting portion and the rocker ratio change guide and adjusts clearance therebetween.

A portion of the rocker ratio change guide which contacts the supporting portion is formed as a curved surface.

The continuous variable valve lift apparatus may further include a movement limit pin which is disposed on the supporting portion and limits a length direction movement of the rocker arm.

A continuous variable valve lift apparatus according to an exemplary embodiment of the present invention may realize continuous variable valve lift by changing length ratio of a rocker arm with simple construction.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
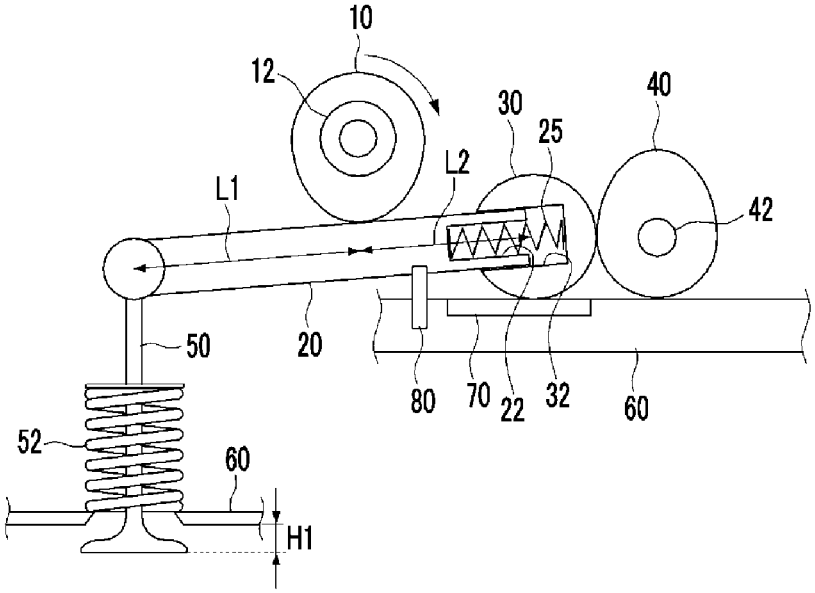
FIG. 1 is a drawing showing a continuous variable valve lift apparatus according to an exemplary embodiment of the present invention operated in low lift mode.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

As those skilled in the art would realize, the described embodiments may be modified in various different ways, all without departing from the spirit or scope of the present invention. Like numerals refer to like elements throughout the specification.

In the drawings, the thickness of layers, films, panels, regions, etc., are exaggerated for clarity.

Figure 2:
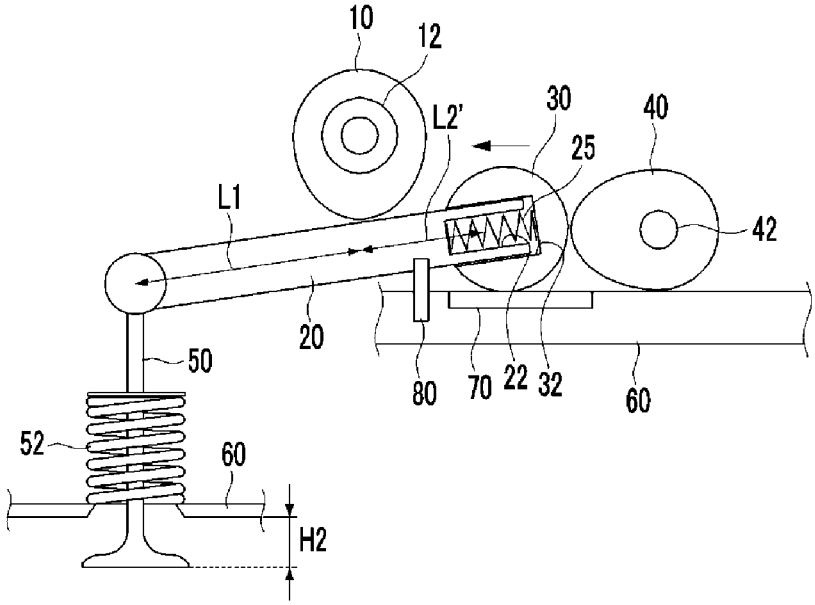
FIG. 2 is a drawing showing a continuous variable valve lift apparatus according to an exemplary embodiment of the present invention operated in high lift mode.

FIG. 1 is a drawing showing a continuous variable valve lift apparatus according to an exemplary embodiment of the present invention operated in low lift mode, and FIG. 2 is a drawing showing a continuous variable valve lift apparatus according to an exemplary embodiment of the present invention operated in high lift mode.

Referring to FIG. 1 and FIG. 2, a continuous variable valve lift apparatus according to an exemplary embodiment of the present invention includes an input cam 10 disposed to an input shaft 12, a valve 50 elastically supported by a valve spring 52, a rocker arm 20 of which an end is connected with the valve 50 and the other end is connected a rocker ratio change guide 30, which is slidable along the length direction of the rocker arm 20 and the rocker arm 20 rotates around the rocker ratio change guide 30 according to rotation of the input cam 10 so as to open and close the valve 50, and a control portion selectively varies position of the rocker ratio change guide 30.

The control portion includes a control shaft 42 parallel to the input shaft 12, and a control cam 40 which is disposed to the control shaft 42, contacts the rocker ratio change guide 30, and varies position of the rocker ratio change guide 30 according to operation of the control shaft 42.

An elastic member 25 is disposed between the rocker arm 20 and the rocker ratio change guide 30 for supplying restoring force to the rocker ratio change guide 30.

A rocker arm insert hole 32 is formed to the rocker ratio change guide 30, and an elastic portion insert hole 22 is formed to the rocker arm 20 and an end of the rocker arm 20 is inserted into the rocker arm insert hole 32. And the elastic member 25 is disposed within the elastic portion insert hole 22 and the rocker arm insert hole 32.

The rocker ratio change guide 30 is disposed on a supporting portion and moves along length direction of the rocker arm 20 on the supporting portion according to the operation of the control portion.

The supporting portion may be a cylinder head 60 and a shim 70 is disposed between the supporting portion 60 and the rocker ratio change guide 30 and adjusts tolerance (lash adjusting) or prepares abrasion.

A portion of the rocker ratio change guide 30 which contacts the supporting portion 60 is formed as a curved surface. The curved surface may reduce abrasion and swing movement around the rocker ratio change guide 30 may be smoothly realized.

A movement limit pin 80 is disposed on the supporting portion 60 and limits length direction movement of the rocker arm 20. And a tolerance may be allowable between the movement limit pin 80 and the rocker arm 20 for allowing swing movement of the rocker arm 20.

Hereinafter, referring to FIG. 1 and FIG. 2, operations of continuous variable valve lift apparatus according to an exemplary embodiment of the present invention will be described.

In the low load operation of an engine, position of the rocker ratio change guide 30 of the continuous variable valve lift apparatus is moved relatively away from the valve 50 by the operation of the control cam 40.

L1 shown in FIG. 1 denotes length between the valve 50 and a contacting point of the input cam 10 and the rocker arm 20, and L2 denotes length between a contacting point of the input cam 10 and the rocker arm 20, and a contacting point of the rocker ratio change guide 30 and the cylinder head 60 or the shim 70.

In the high load operation of an engine, position of the rocker ratio change guide 30 of the continuous variable valve lift apparatus is moved relatively closed to the valve 50 by the operation of the control cam 40. That is, the position of the rocker ratio change guide 30 shown in FIG. 2 is changed along arrow direction.

And then the L1 shown in FIG. 1 shortens to L2' shown in FIG. 2.

Comparing the FIG. 1 and FIG. 2, the rocker arm 20 swings around the rocker ratio change guide 30 and thus the valve lift is changed from H1 to H2 in the high load operation.

The relationship may be described as follows.

$$H1:H2=L1/L2:L1/L2'$$

That is, the relative lift may be changed as the length ratio of the rocker arm is changed.

In an exemplary embodiment of the present invention, the control portion is constituted by the control shaft 42 and control cam 40 as an example, but is not limited thereto. Other exemplary variations for changing the length ratio of the rocker arm 20 swinging around the rocker ratio change guide 30 may be applied and the modifications and equivalent arrangements is included within the spirit and scope of the appended claims.

In the description of the present invention, the low load operation and the high load operation are described for easy comprehension. However various valve profile may be achieved by the operations of the control cam 40 and the repeated description will be omitted.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve lift apparatus comprising:
an input cam disposed to an input shaft;
a valve elastically supported by a valve spring;
a rocker arm of which an end is connected with the valve and the other end is slidably engaged to a rocker ratio change guide; and
an elastic member disposed between the other end of the rocker arm and the rocker ratio change guide for supplying a restoring force to the rocker ratio change guide;
wherein the rocker ratio change guide is movable along a length direction of the rocker arm;
wherein the input cam is engaged to a side of the rocker arm and the rocker arm rotates around the rocker ratio change guide according to a rotation of the input cam so as to open and close the valve;
wherein a control portion selectively varies a relative distance between the rocker ratio change guide and the end of the rocker arm;
wherein the control portion includes:
a control shaft parallel to the input shaft; and
a control cam which is disposed to the control shaft, contacts the rocker ratio change guide, and varies the relative distance between the rocker ratio change guide and the end of the rocker arm according to a rotation of the control shaft;
wherein a rocker arm insert hole is formed to the rocker ratio change guide;
wherein an elastic portion insert hole is formed to the other end of the rocker arm and the other end of the rocker arm is slidably inserted into the rocker arm insert hole; and
wherein the elastic member is disposed within the elastic portion insert hole and the rocker arm insert hole.

2. The continuous variable valve lift apparatus of claim 1, wherein the rocker ratio change guide is disposed on a supporting portion and moves along a length direction of the rocker arm on the supporting portion according to an operation of the control portion.

3. The continuous variable valve lift apparatus of claim 2, wherein the supporting portion is a cylinder head.

4. The continuous variable valve lift apparatus of claim 2, further including a shim which is disposed between the supporting portion and the rocker ratio change guide and adjusts clearance therebetween.

5. The continuous variable valve lift apparatus of claim 2, wherein a portion of the rocker ratio change guide which contacts the supporting portion is formed as a curved surface.

6. The continuous variable valve lift apparatus of claim 2, further including a movement limit pin which is disposed on the supporting portion and limits a length direction movement of the rocker arm.

7. A continuous variable valve lift apparatus comprising:
an input cam disposed to an input shaft;
a valve elastically supported by a valve spring;
a rocker arm of which an end is connected to the valve and opens the valve according to an operation of the input cam;
a rocker ratio change guide which is disposed to the other end of the rocker arm and slidable along a length direction of the rocker arm on a supporting portion; and
a control portion selectively varies position of the rocker ratio change guide with respect to the rocker arm;
wherein the rocker arm swings around the rocker ratio change guide according to the operation of the input cam;
wherein a rocker arm insert hole is formed to the rocker ratio change guide;
wherein an elastic portion insert hole is formed to the other end of the rocker arm and the other end of the rocker arm is slidably inserted into the rocker arm insert hole; and
wherein an elastic member is disposed within the elastic portion insert hole and the rocker arm insert hole for supplying restoring force to the rocker ratio change guide.

8. The continuous variable valve lift apparatus of claim 7, wherein the control portion includes:
a control shaft parallel to the input shaft; and
a control cam which is disposed to the control shaft, contacts the rocker ratio change guide, and varies a relative distance between the rocker ratio change guide and the rocker arm according to an operation of the control shaft.

9. The continuous variable valve lift apparatus of claim 7, wherein a portion of the rocker ratio change guide which contacts the supporting portion is formed as a curved surface.

10. The continuous variable valve lift apparatus of claim 7, further including a movement limit pin which is disposed on the supporting portion and limits a length direction movement of the rocker arm.

11. A continuous variable valve lift apparatus comprising:
an input cam disposed to an input shaft;
a valve elastically supported by a valve spring;
a rocker arm of which an end is connected to the valve and opens the valve according to an operation of the input cam;
a rocker ratio change guide which is disposed to the other end of the rocker arm and slidable along a length direction of the rocker arm on a supporting portion;
a control portion selectively varies position of the rocker ratio change guide with respect to the rocker arm; and a shim which is disposed between the supporting portion and the rocker ratio change guide and adjusts clearance therebetween;

wherein the rocker arm swings around the rocker ratio change guide according to the operation of the input cam.

* * * * *